US007878484B2

(12) United States Patent
Kitchens, Sr.

(10) Patent No.: US 7,878,484 B2
(45) Date of Patent: Feb. 1, 2011

(54) VEHICLE-MOUNTABLE HOIST

(76) Inventor: James Larry Kitchens, Sr., 355 N.W. 2nd St., Lake Butler, FL (US) 32054

( * ) Notice: Subject to any disclaimer, the term of this patent is extended or adjusted under 35 U.S.C. 154(b) by 0 days.

(21) Appl. No.: 12/587,494

(22) Filed: Oct. 7, 2009

(65) Prior Publication Data

US 2010/0200822 A1 Aug. 12, 2010

Related U.S. Application Data

(60) Provisional application No. 61/206,908, filed on Feb. 6, 2009.

(51) Int. Cl.
*B66D 1/36* (2006.01)

(52) U.S. Cl. ..... 254/326; 254/323; 254/325; 254/328; 212/180; 212/306

(58) Field of Classification Search ..... 254/323, 254/325, 326, 327, 328, 380; 414/680, 550; 212/180, 306
See application file for complete search history.

(56) References Cited

U.S. PATENT DOCUMENTS

| | | | | | |
|---|---|---|---|---|---|
| 3,843,093 | A * | 10/1974 | Thompson et al. | ..... | 254/325 |
| 4,840,534 | A | 6/1989 | Totty | | |
| 5,064,078 | A | 11/1991 | Van Staveren | | |
| 5,520,498 | A * | 5/1996 | DiBartolomeo | ..... | 414/680 |
| 6,065,621 | A * | 5/2000 | Fatemi et al. | ..... | 212/301 |
| 6,089,818 | A * | 7/2000 | Hill et al. | ..... | 414/563 |
| 6,152,675 | A * | 11/2000 | Compton | ..... | 414/543 |
| 6,821,075 | B2 * | 11/2004 | van der Horn | ..... | 414/462 |
| 6,981,834 | B1 * | 1/2006 | Henry | ..... | 414/462 |
| 7,374,388 | B2 * | 5/2008 | Holt | ..... | 414/462 |
| 2007/0092362 | A1 * | 4/2007 | Holt | ..... | 414/462 |
| 2007/0108731 | A1 * | 5/2007 | McBroom | ..... | 280/477 |
| 2009/0152227 | A1 * | 6/2009 | Thompson et al. | ..... | 212/348 |

* cited by examiner

*Primary Examiner*—Emmanuel M Marcelo
(74) *Attorney, Agent, or Firm*—Patrick Stellitano

(57) ABSTRACT

Embodiments include an apparatus comprising a first part to be removably secured to a receiver hitch of a vehicle. The first part is removably integrated with a boom receiver. The boom receiver can be removably connected to a boom extending upward at an angle from the first part. An electric powered winch can be attached to the boom receiver. The winch includes a cable to hang down from the boom. Coupled to the cable is a device to connect an object to be moved by the apparatus.

30 Claims, 5 Drawing Sheets

VEHICLE-MOUNTABLE HOIST

PRIORITY

This application claims priority of Provisional U.S. Patent Application No. 61/206,908, filed on Feb. 6, 2009, which is incorporated herein for all purposes.

FIELD

The present description is in the field of hoists.

BRIEF DESCRIPTION OF THE DRAWINGS

Aspects will become apparent upon reading the following detailed description and upon reference to the accompanying drawings in which like references may indicate similar elements.

DETAILED DESCRIPTION OF EMBODIMENTS

The following is a detailed description of embodiments. The amount of detail offered is not intended to limit the anticipated variations of embodiments; but, on the contrary, the intention is to cover modifications, equivalents, and alternatives falling within the scope of the appended claims. The detailed descriptions below are designed to make such embodiments obvious to a person of ordinary skill in the art.

Embodiments include a hoist that connects to a receiver hitch of a vehicle. The hoist includes a first part to be received by the receiver hitch of the vehicle. The hoist includes a second part forming a sleeve through which the first part is to pass. A boom receiver rigidly attaches to the second part. A boom that is position-able in the boom receiver extends upward from the boom receiver at an angle from the first part. The hoist may further include a winch having a cable, the cable to be routed from a spool of the winch over a top end of the boom and to be routed downward from the top end of the boom, the cable coupled to a hook to hook an object to be hoisted.

One illustrative embodiment is an apparatus that includes a first part to be removably secured to a receiver hitch of a vehicle, the first part to be integrated with a receiver of a removable boom. The apparatus includes a boom receiver and a removable boom that can be connected to the boom receiver to extend upward at an angle from the first part. The apparatus may further include a winch attached to the boom receiver, the winch comprising a cable to hang down from an upper portion of the removable boom, the cable coupled to a device to connect to an object to be moved by the apparatus.

Another illustrative embodiment is a method for hoisting an object. The method comprises installing a boom onto a receiver hitch of a vehicle. The method further comprises spooling out a length of cable from a winch integrated with the boom so that a hook coupled to the cable hanging down from the boom can reach the object. The method further comprises hooking the object with the hook and spooling in a length of cable via the winch to hoist the object.

Figure 1A:
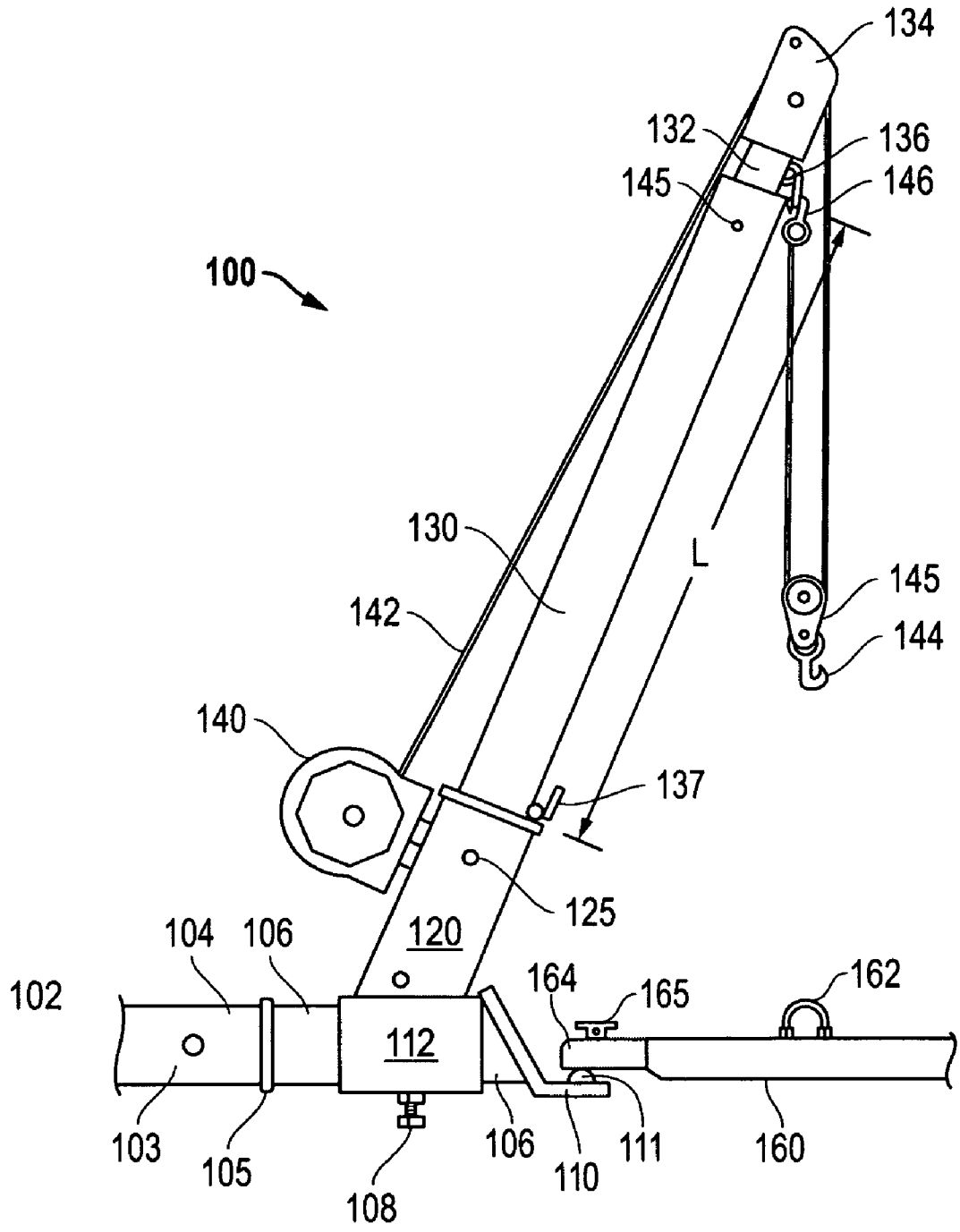
FIG. 1A depicts a hoist with a winch that is mounted on a vehicle.

FIG. 1A depicts a hoist 100 with a winch 140 that is mounted on a vehicle 102. The vehicle 102 has a receiver hitch 104 that exhibits a metal sleeve and a collar 105 that receives a shaft 106. The shaft 106 is restrained to the receiver hitch 104 by a pin inserted through hole 103. Advantageously, many vehicles come with such a receiver hitch installed at the time of manufacture for towing purposes. The shaft 106 slides through a sleeve 112. A set screw 108 screws through the sleeve 112 and pushes against the shaft 106 to help make the sleeve 112 rigid with respect to the shaft 106.

In one embodiment, the winch 140 is a 12 Volt electric winch which may be powered by a battery of the vehicle 102. In some embodiments, the winch 140 is operable at more than one speed. Further, the winch 140 may have a panel with buttons to control the power, direction, and speed of the winch to coil or uncoil a cable 142. For example, wind and unwind buttons may be provided on the panel. Alternatively, the winch may be operated by a remote control device. Thus, in one embodiment, circuitry at the winch can receive and process signals wirelessly transmitted from the remote control device.

Welded to the sleeve 112 is a boom receiver 120 that makes an angle θ with respect to an axis of the sleeve 112. In one embodiment, the angle θ is about 67 degrees and the length of the boom receiver 120 is about 7-9 inches. The boom receiver 120 receives a boom 130 which can be removably secured to the boom receiver 120 using a pin 125. In one embodiment, the boom is about two feet long. In one embodiment, the boom 130 is at least partially hollow and contains a boom extension 132. In one embodiment, the boom extension 132 can extend the length of the boom by about 14-20 inches. The boom extension 132 can be removably secured to the boom 130 using a pin or bolt 145.

Attached to the boom extension 132 is a sheave assembly 134 that has a pulley for conducting the cable 142 upward from the winch 140 and downward to a pulley block 145. The pulley block 145 conducts the cable 142 downward from the sheave assembly 134 and upward to an eye 136 at the upper end of the boom extension 132. The eye 136 receives a hook 146 connected to the end of the cable 142. By routing the cable so that two vertical lengths of cable are divided by the pulley block 145, the force required to lift a given load is decreased by a factor of about two.

Note also, that the eye 136 is shown positioned on the boom extension 132. Another eye could also be provided on the upward most end of the boom 130 so that the user of the hoist can hook the hook 146 to either the eye on the boom extension 132 or the eye on the upper end of the boom 130.

A hook 144 attached to the pulley block 145 may be hooked to an eye 162 of a trailer 160. Or the hook can hook a safety chain attached to the trailer 160. In one embodiment, when a distal end 164 of the trailer 160 is aligned to catch a ball 111 of a ball mount 110 welded onto the shaft 106, the hook 144 is aligned with the eye 162 so that the section of cable 142 from eye 136 to pulley block 145 is vertical. Another eye 137 attached to the boom 130 is provided to secure the hook 144 when the hoist 100 is not in use.

Figure 1B:
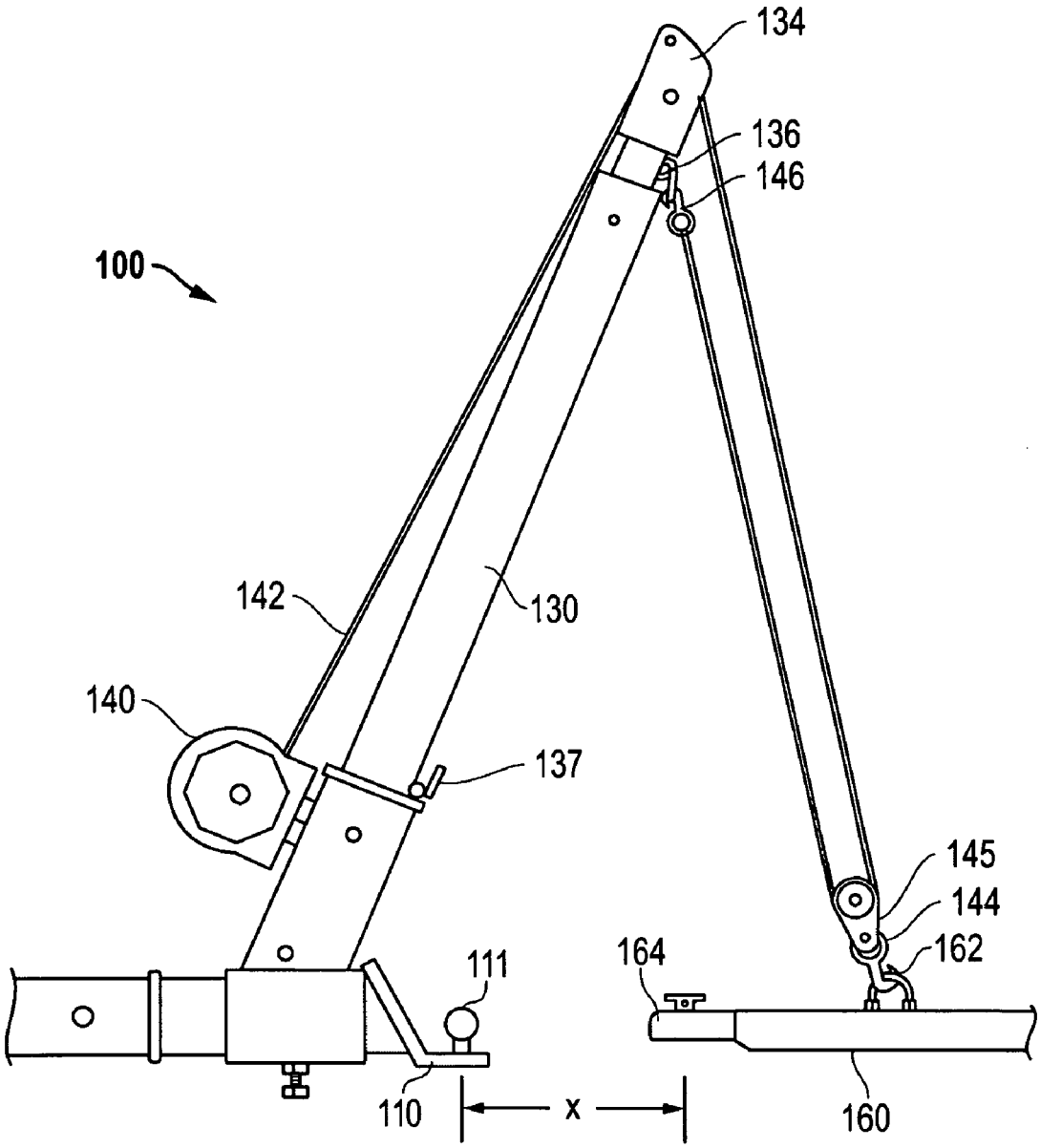
FIG. 1B depicts a hoist connected to a trailer.

FIG. 1B shows the hoist 100 being used to hoist the trailer 160 into a position where the distal end 164 of the trailer 160 is over the ball 111 on the ball mount 110. To begin, the vehicle is backed up to the trailer so that the trailer end 164 is less than about five or six feet from the ball 111. Accurate positioning of the vehicle is not required. Then, the cable 142 is spooled out from the winch 140 until the hook 144 of the pulley block 145 reaches the eye 162, whereupon the hook 144 is hooked onto the eye 162. Or the hook can hook a safety chain attached to the trailer. The winch direction is then reversed to coil up a portion of the cable 142, thereby pulling the trailer 160 forward until the trailer end 164 is aligned with the ball 111. In a similar manner, the hoist 100 can be used to pull a boat onto a boat trailer from a lake. As another example, the hoist 100 can be used to tilt a trailer that carries one or more objects or vehicles such as an all-terrain vehicle. The trailer can be tilted by lifting a front end of the trailer with the hoist 100 so that a rear end flat bed of the trailer touches the ground. When the rear end of the trailer touches the ground, an object or vehicle can be easily offloaded from the trailer.

Figure 2:
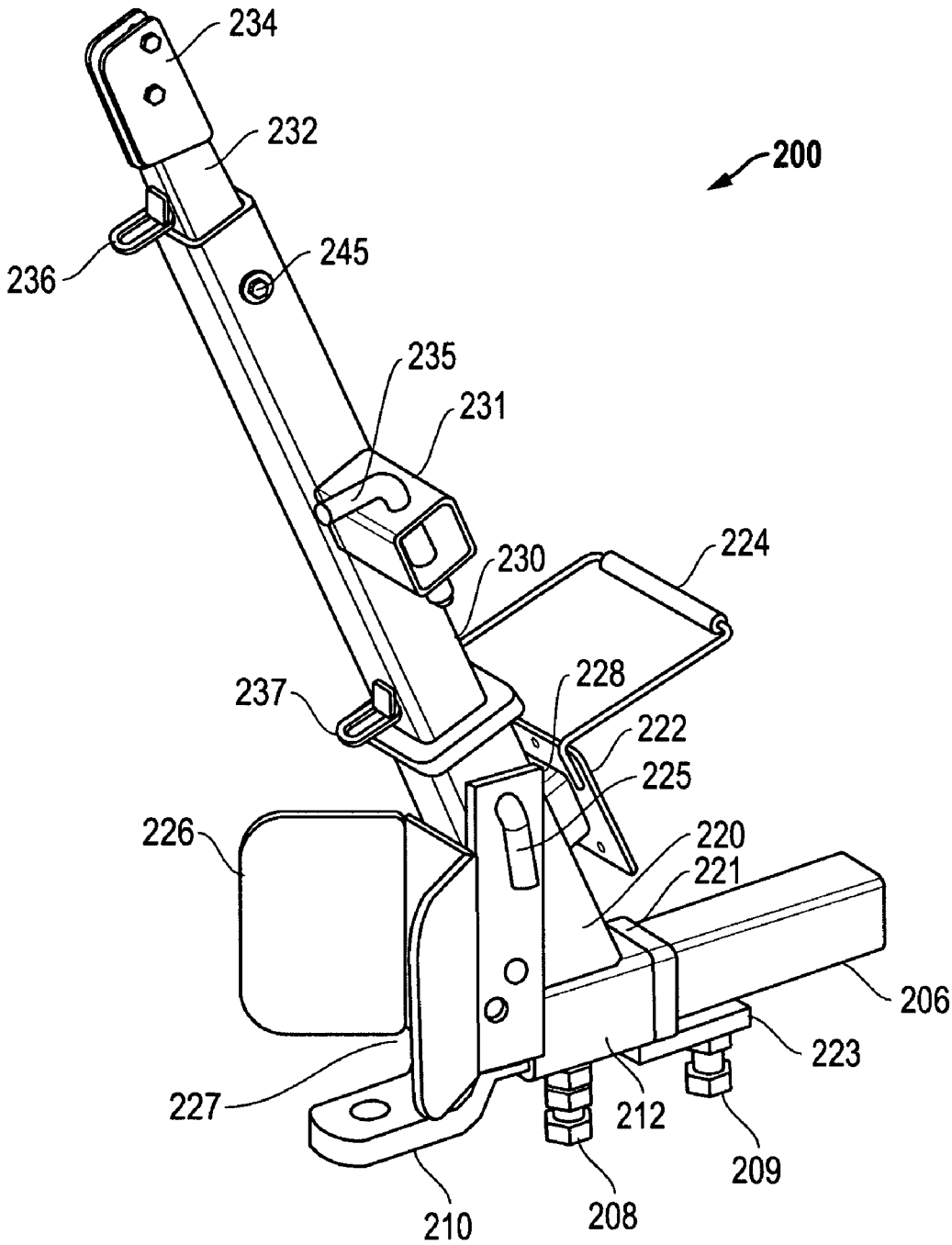
FIG. 2 depicts a hoist in perspective view without a winch.

FIG. 2 shows a perspective view of a hoist 200 that can be easily coupled via a shaft 206 to a receiver hitch of a vehicle. At an end of the shaft 206 is a ball mount 210 for mounting a ball not shown in FIG. 2. The shaft 206 passes through a sleeve 212 and is secured in part by a set screw 208. To further secure the hoist 200, a bolt 209 passes through a plate 223 and presses against the shaft 206. The plate 223 is welded or otherwise affixed to a collar 221. When the bolt 209 presses against the shaft 206, the collar 221 crimps against the shaft 206 to provide stiffening and to take out any play between the shaft 206 and the sleeve 212 so that the shaft 206 and the sleeve 212 do not move relative to each other.

Welded to the sleeve 212 is a boom receiver 220 that makes an angle with respect to an axis of the shaft 206. The boom receiver 220 receives a pin 225 which passes through a plate of a guiding apparatus 226 and passes through the boom receiver 220 and through a bottom portion of a boom 230 which extends upward from the boom receiver 220. Thus, the pin 225 secures the boom 230 to the boom receiver 220 and secures an upper portion of the guidance apparatus 226 to the boom receiver 220 so that the guidance apparatus 226 may pivot about the pin 225.

When the guidance apparatus 226 pivots about the pin 225, the bottom 227 of the guidance apparatus swings away from the boom receiver 220. In operation, the hook 144 of the hoist may be hooked onto the bottom 227 of the guidance apparatus 226 to lift it upward and outward toward the ball 111. This is useful when the end 164 of the trailer 160 is closer to the vehicle 102 than the ball 111. By placing the hook 144 on the bottom 227 and causing the winch to coil in the cable to lift the bottom 227 upward and outward, the guidance apparatus 226 pushes against the end 164 of the trailer 160, pushing it backward until the end 164 of the trailer 160 aligns with the ball 111. In one embodiment, the guidance apparatus 226 pushes the trailer back by about 3 inches.

In some embodiments, the boom 230 receives a boom extension 232 which may be extended outward to increase the length of the boom provided by the hoist 200. The boom extension 232 may be secured in the boom 230 by a removable pin 245. Attached to the boom extension 232 is an eye 236. Attached to the boom 230 is an eye 237. Eye 236 receives a hook 146 at the end of the cable of a winch (not shown in FIG. 2). Eye 237 receives the hook 144 of FIG. 1A when the hoist 200 is not in use. Attached to the boom extension 232 is a sheave assembly 234 that has a pulley for conducting a cable over the end of the boom, as shown in FIGS. 1A and 1B.

Welded or otherwise attached to the boom 230 is a stub 231 that receives a pin 235. The purpose of the stub 231 is to insert into the boom receiver 220 when the device is in a storing configuration, as shown in FIG. 3.

Welded or otherwise attached to the boom receiver 220 is a stub 228. Welded or otherwise attached to the stub 228 is a plate 222. The plate 222 is for mounting a winch, such as the winch 140 of FIGS. 1A and 1B. Welded to the plate 222 is a handle 224 for carrying the hoist.

Figure 3:
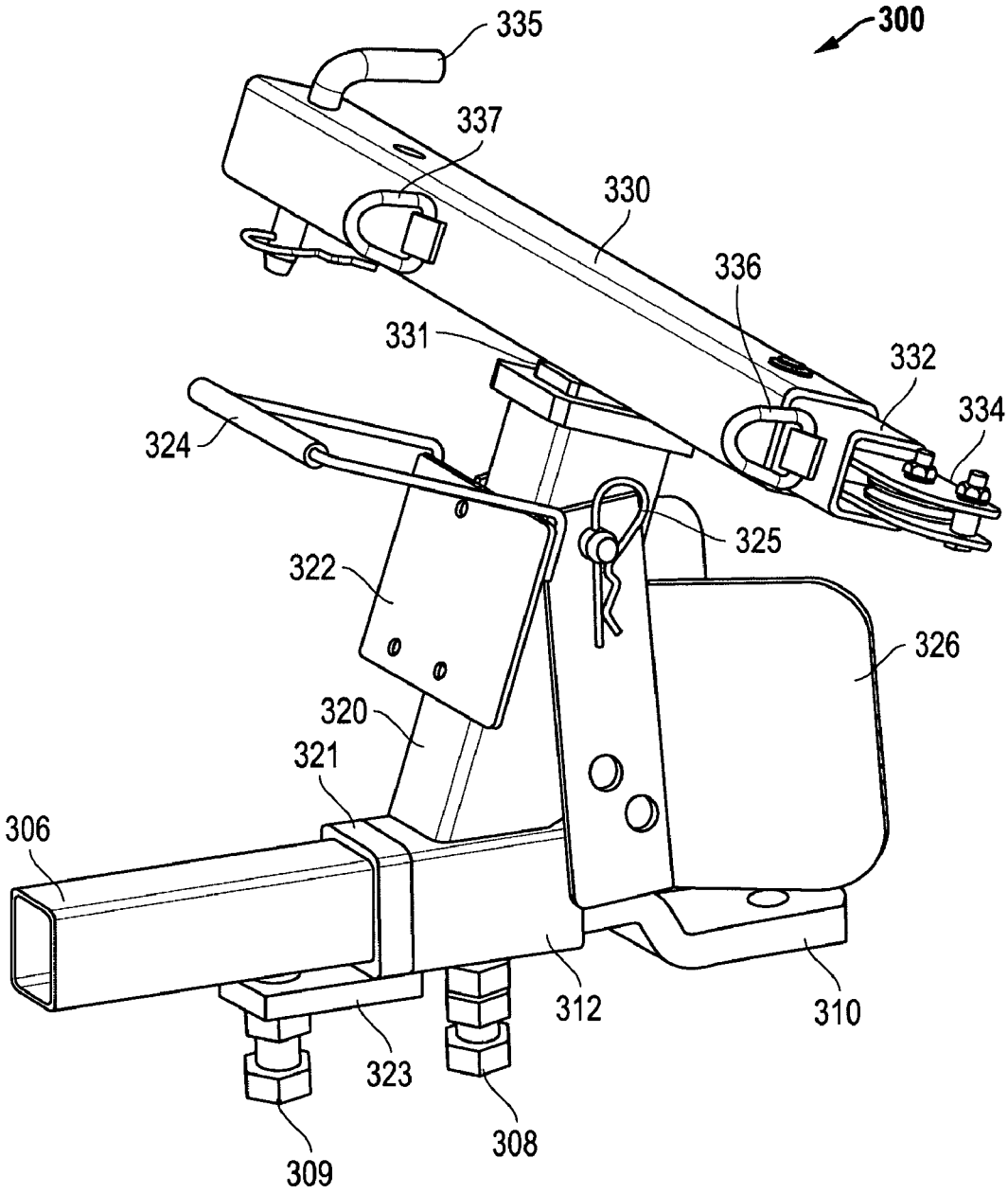
FIG. 3 depicts the hoist of FIG. 2 in perspective view in a storing configuration.

FIG. 3 shows a perspective view of a hoist 300 in a storing configuration, having a shaft 306 that mates with a receiver hitch of a vehicle. At an end of the shaft 306 is a ball mount 310 for mounting a ball not shown in FIG. 3. The shaft 306 passes through a sleeve 312 and is secured in part by a set screw 308. To further secure the hoist 300, a bolt 309 passes through a plate 323 and presses against the shaft 306. The plate 323 is welded or otherwise affixed to a collar 321. When the bolt 309 presses against the shaft 306, the collar 321 crimps against the shaft 306 to provide stiffening and to take out any play between the shaft 306 and the sleeve 312 so that the shaft 306 and the sleeve 312 do not move relative to each other.

Welded to the sleeve 312 is a boom receiver 320 that makes an angle with respect to an axis of the shaft 306. The boom receiver 320 receives a pin 325 which passes through a plate of a guiding apparatus 326 and passes through the boom receiver 320 and through a stub 331 of a boom 330. Thus, the pin 325 secures the boom 330 to the boom receiver and secures an upper portion of the guidance apparatus 326 to the boom receiver 320 so that the guidance apparatus may pivot about the pin 325. When the guidance apparatus 326 pivots about the pin 325, the bottom of the guidance apparatus 326 swings forward and away from the boom receiver 320.

When not in use, the winch 140 may wind up excess cable and the boom 330 can be positioned at a right angle to the boom receiver 320. Advantageously, when the hoist 300 is in the storing configuration shown in FIG. 3 and is installed on a pick up truck receiver hitch, the tailgate of the pick up truck can be lowered to a horizontal position without interference from the hoist 300, for most tailgates. Some tailgates may require lowering the assembly by a few inches. FIG. 3 also shows the eyes 337 and 336, a boom extension 332, and a sheave assembly 334, corresponding to the like-numbered parts in FIG. 2

Figure 4:
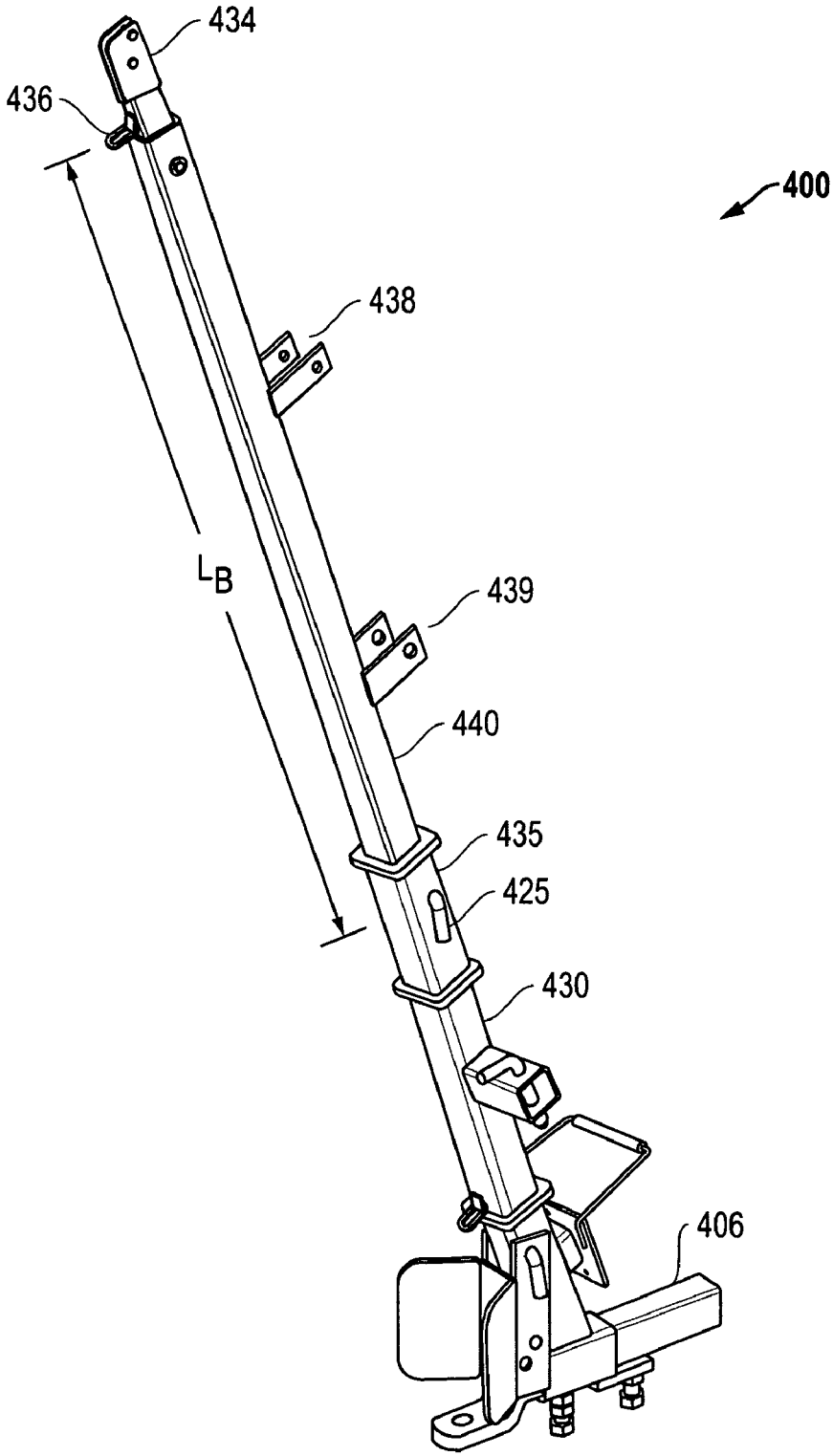
FIG. 4 depicts a hoist with a long boom.

FIG. 4 shows an embodiment of an extended hoist 400 with a long boom attachment 440 that mates with a coupling element 435 attached to the boom 430. The long boom attachment 440 is secured to the coupling element 435 via a pin 425. At the distal end of the long boom attachment 440 is a sheave assembly 434 and an eye 436 to receive a cable and hook, respectively. The brackets 438 and 439 are for mounting the long boom 440 to the short boom 430 when the apparatus is in storage. In one use of the extended hoist 400, a deer may be hoisted upward to hang from the long boom attachment 440 so that the deer can be field-dressed. In one embodiment, the long boom attachment is about 48 inches long so that the sheave assembly 434 of the long boom attachment 440 is about 10 feet off the ground.

In one embodiment, the shaft 406 is just the right size to slide into the standard receiver hitch of a vehicle such as a pick truck, sport utility vehicle, or van. An adapter may be coupled to the shaft 406 to adapt the shaft 406 to the size of a standard receiver hitch of an all terrain vehicle (ATV), which is smaller in size than the receiver hitch of a pick up truck, sport utility vehicle, or van.

The present embodiments and some of their advantages have been described in detail. It should be understood that various changes, substitutions and alterations can be made herein without departing from the scope of the invention as defined by the appended claims. An embodiment of the invention may achieve multiple objectives, but not every embodiment falling within the scope of the attached claims will achieve every objective. Moreover, the scope of the present application is not intended to be limited to the particular embodiments of the process, machine, manufacture, composition of matter, means, methods and steps described in the specification. One of ordinary skill in the art will readily appreciate from the disclosure of the present invention that processes, machines, manufacture, compositions of matter, means, methods, or steps, presently existing or later to be developed are equivalent to, and fall within the scope of, what is claimed. Accordingly, the appended claims are intended to include within their scope such processes, machines, manufacture, compositions of matter, means, methods, or steps.

What is claimed is:

1. A hoist that connects to a receiver hitch of a vehicle, comprising:

a first part to be received by the receiver hitch of the vehicle;

a second part forming a sleeve through which the first part is to pass;

a boom receiver rigidly attached to the second part; and a boom that is position-able in the boom receiver to extend upward from the boom receiver at an angle from the first part.

2. The hoist of claim 1, further comprising a winch having a cable, the cable to be routed from a spool of the winch over a top end of the boom and to be routed downward from the top end of the boom, the cable coupled to a hook to hook an object to be hoisted.

3. The hoist of claim 1, wherein the first part is a shaft.

4. The hoist of claim 1, wherein a winch is mounted to a plate attached to the boom receiver.

5. The hoist of claim 1, wherein the boom makes an angle of about 67 degrees from a horizontal line.

6. The hoist of claim 1, wherein the boom is about two feet long.

7. The hoist of claim 1, further comprising a boom extension that inserts into the boom.

8. The hoist of claim 1, further comprising a boom extension that inserts into a coupling mechanism coupled to the boom and wherein the boom extension is greater than 2 feet long.

9. The hoist of claim 1, wherein the first part is adapted to be received by a receiver hitch of an all terrain vehicle (ATV).

10. The hoist of claim 1, further comprising an adapter to adapt a size of the first part from a size of a receiver hitch of a first vehicle to a size of a receiver hitch of a second vehicle.

11. The hoist of claim 1, further comprising a guidance mechanism that pivots about a pin inserted through the boom receiver.

12. The hoist of claim 11, wherein the guidance mechanism is adapted to be pulled forward to push a trailer backward to align an end of the trailer to catch a ball of a ball mount.

13. The hoist of claim 12, wherein the trailer may be pushed backward by the guidance mechanism by about 3 inches.

14. The hoist of claim 1, wherein the first part is made rigid with respect to the second part.

15. The hoist of claim 14, wherein the rigidity is at least partially achieved by a stiffener that has a collar that fits around the first part and a bolt to tighten the stiffener so that the collar crimps the first part.

16. The hoist of claim 14, wherein the rigidity is at least partially achieved by a set screw that screws through a hole in the second part to make contact with the first part.

17. The hoist of claim 1, wherein, in a storage configuration, the boom can be coupled to the boom receiver at right angles to the boom receiver when the hoist is not in use.

18. The hoist of claim 17, wherein a tailgate of the vehicle can be lowered without interference from the hoist when the hoist is in the storage configuration.

19. An apparatus, comprising:

a first part to be removably secured to a receiver hitch of a vehicle;

a second part to be removably coupled to the first part via an encompassing sleeve, the second part including a rigidly attached hollow boom receiver extending upward at an acute angle to a horizontal plane; and a removable boom to be removably inserted into the hollow boom receiver to extend upward at an acute angle from the horizontal plane.

20. The apparatus of claim 19, further comprising a winch attached to the boom receiver, the winch comprising a cable to hang down from an upper portion of the removable boom, the cable to be coupled to a device to connect to an object to be moved by the apparatus.

21. The apparatus of claim 20, wherein the device is a hook.

22. The apparatus of claim 20, wherein electric power for the winch is obtainable from a power source of the vehicle.

23. The apparatus of claim 20, wherein the winch is operable via a remote control device.

24. The apparatus of claim 19, wherein the first part to be removably secured to the receiver hitch is a rectangular shaft receivable by a rectangular sleeve of the receiver hitch.

25. The apparatus of claim 19, further comprising a long boom extension to enable the apparatus to hang a deer off the ground to be field dressed.

26. A method of hoisting an object, the method comprising:

coupling a first part to a receiver hitch of a vehicle;

coupling a second part to the first part via an encompassing sleeve, the second part including a rigidly attached hollow boom receiver extending upward at an acute angle from a horizontal plane;

removably inserting a removable boom into the boom receiver;

spooling out a length of cable from a winch integrated with the boom so that a hook coupled to the cable hanging down from the boom can reach the object;

hooking the object with the hook; and spooling in a length of cable via the winch to hoist the object.

27. The method of claim 26, further comprising providing a connection from a power source of the vehicle to the winch.

28. The method of claim 26, wherein spooling in a length of cable to hoist the object comprises continuing to spool in the cable until a ball mount of the second part aligns with a tongue of the object.

29. The method of claim 26, wherein the object is a trailer and wherein spooling in a length of cable to hoist the trailer aligns a tongue of the trailer with the hitch ball on a shaft that is received by the receiver hitch of the vehicle.

30. The method of claim 26, wherein the object is a trailer and wherein spooling in a length of cable to hoist the trailer tilts the trailer so that an opposite end of the trailer contacts the ground to enable unloading items from the trailer.

* * * * *